US011464334B2

(12) United States Patent
Yu

(10) Patent No.: US 11,464,334 B2
(45) Date of Patent: Oct. 11, 2022

(54) DETACHABLE FIVE-STAR BASE

(71) Applicant: ANJI JINTAI FASTENER CO., LTD., Huzhou (CN)

(72) Inventor: Jinqian Yu, Huzhou (CN)

(73) Assignee: Anji Jintai Fastener Co., Ltd., Zhejiang Province (CN)

( * ) Notice: Subject to any disclaimer, the term of this patent is extended or adjusted under 35 U.S.C. 154(b) by 0 days.

(21) Appl. No.: 17/418,221

(22) PCT Filed: May 28, 2019

(86) PCT No.: PCT/CN2019/088733
§ 371 (c)(1),
(2) Date: Jun. 24, 2021

(87) PCT Pub. No.: WO2020/173007
PCT Pub. Date: Sep. 3, 2020

(65) Prior Publication Data

US 2022/0110447 A1 Apr. 14, 2022

(30) Foreign Application Priority Data

Feb. 26, 2019 (CN) ..... 201910140507.X
Feb. 26, 2019 (CN) ..... 201920239696.1

(51) Int. Cl.
*A47B 91/00* (2006.01)
*A47C 7/00* (2006.01)

(52) U.S. Cl.
CPC ..... *A47B 91/005* (2013.01); *A47C 7/004* (2013.01)

(58) Field of Classification Search
CPC ..... A47B 91/005; A47C 7/004; A47C 7/006
See application file for complete search history.

(56) References Cited

FOREIGN PATENT DOCUMENTS

| | | | |
|---|---|---|---|
| CN | 106617849 | | 5/2017 |
| CN | 206197513 U | * | 5/2017 |
| CN | 206257430 | | 6/2017 |

(Continued)

OTHER PUBLICATIONS

PCT Written Opinion of the International Searching Authority dated Dec. 5, 2019 for corresponding PCT International Application No. PCT/CN2019/088733.

(Continued)

*Primary Examiner* — Kimberly T Wood
(74) *Attorney, Agent, or Firm* — Olive Law Group, PLLC

(57) ABSTRACT

The disclosure belongs to the technical field of support structures, and in particular relates to a detachable five-star base. In the disclosure, the clamping plate, the arc-shaped groove plate and the support block are arranged on the center block, and the connecting groove, the arc-shaped connecting plate and the jacking block are arranged on the detachable foot to achieve the effective disassembly and assembly of the five-star foot. The disclosure has a reasonable and effective detachable structure of the five-star foot, the detachable feet are easy to be engaged and positioned before disassembly and assembly, the resistance is moderate, the operation is convenient, the support strength after installation is large. The friction and fixing effect between the detachable feet and the center block is good, the detachable feet are not easy to rotate and fall apart, and the number of detachable feet can be adjustable.

8 Claims, 9 Drawing Sheets

(56) References Cited

FOREIGN PATENT DOCUMENTS

| | | | | |
|---|---|---|---|---|
| CN | 206257430 | U | * | 6/2017 |
| CN | 206560195 | U | | 10/2017 |
| CN | 206576607 | | | 10/2017 |
| CN | 206822372 | U | * | 1/2018 |
| CN | 2985211 | A1 | * | 3/2018 |
| CN | 207604676 | U | * | 7/2018 |
| CN | 207653878 | U | * | 7/2018 |
| CN | 109691813 | A | | 4/2019 |
| WO | 96/32866 | A1 | | 10/1996 |

OTHER PUBLICATIONS

PCT International Search Report of the International Searching Authority dated Dec. 5, 2019 for corresponding PCT International Application No. PCT/CN2019/088733.

* cited by examiner

DETACHABLE FIVE-STAR BASE

CROSS REFERENCE TO RELATED APPLICATIONS

This is a national phase application of PCT Application No. PCT/CN2019/088733, filed May 28, 2019, which claims priority to Chinese Patent Application No. 201910140507X, filed Feb. 26, 2019, and also claims priority to Chinese Patent Application No. 2019202396961, filed Feb. 26, 2019, the contents of which are incorporated herein by reference in their entireties.

TECHNICAL FIELD

The disclosure belongs to the technical field of support structures, and in particular, relates to a detachable five-star base.

BACKGROUND

Swivel chair foot, also known as five-star foot, is commonly used as support accessories for swivel chairs and office chairs. They are used to install lifting cylinders and support the swivel chair. The existing swivel chair foot is usually of integral structure. On the one hand, when one of the feet is damaged, it is necessary to replace the entire five-star foot, which causes unnecessary waste. On the other hand, its integral structure takes up a lot of space, especially when storing or packing and transporting, it wastes a lot of space and high transportation costs, which increases the expenditure of the enterprise. The existing detachable five-star base is either easy to disassemble and assemble but have low structural strength, resulting in the feet being easy to rotate and fall and disintegrate as long as the five-star foot are lifted off the ground; or with good structural strength but convenient for disassembly and assembly. New type of detachable five-star base with high structural strength, and moderate disassembly workload and moderate difficulty is urgently needed in market.

The patent with Publication No: CN204599892U and Publication Date: Sep. 2, 2015 discloses a seat five-star foot with easy disassembly and assembly, which includes a mounting base and a plurality of supporting feet. The mounting seat is composed of a sleeve and at least three foot connecting tubes fixedly connected to the sleeve. The foot connecting tube is provided with an elastic positioning pin at one end connected to the foot connecting tube, and the foot is provided with a positioning hole connected with the elastic positioning pin at a side wall of one end connected to the foot connecting tube. The elastic positioning pin on the foot connecting tube is clamped into the positioning hole on the foot.

However, the five-star foot of the detachable seat in that patent application has the problem of insufficient structural strength.

SUMMARY

The object of the present disclosure is to provide a detachable five-star base, which can be provided with clamping plates, an arc-shaped groove plates and support blocks on the center block, and connecting grooves, arc-shaped connecting plates and jacking blocks on the detachable foot, so as to achieve the effect of effective disassembly and use of the five-star foot. The disclosure has a reasonable and effective disassembly and assembly structure of the five-star foot, the detachable feet are easy to be engaged and positioned before disassembling, and have moderate resistance when disassembling. The operation is convenient, the support strength after installation is large, and the friction and fixing effect between the detachable feet and the center block is good when lifted off the ground. The detachable feet are not easy to rotate and fall apart, and the number of detachable feet is adjustable. The overall disassembly and assembly workload is not much. There is advantage of flexible and efficient disassembly and assembly time, which can meet different usage requirements.

The technical solution adopted by the present disclosure to solve the above-mentioned problems is: a detachable five-star base may include an outer pentagonal central block, and five support feet respectively arranged on the sides of the central block. The support feet may include 1 to 4 detachable feet and the remaining fixed feet, or include all five of the detachable feet. The detachable five-star base may further include:

clamping plates on both sides of five sides of the central block;

arc-shaped groove plates arranged at an upper and lower ends of inner sides of the clamping plate;

connecting grooves arranged on the detachable feet on connecting ends;

arc-shaped connecting plates provided on the connecting grooves and configured for hooking and fixing with the arc-shaped groove plate;

support blocks provided on the sides of the center block and located between two clamping plates, and configured to support upper tank plates of the connecting groove; and jacking blocks, each of which is arranged between two of the arc-shaped connecting plates and configured to block and limit a lower portion of each of the support blocks before inserting, and to support upwardly after inserting.

A further preferred technical solution may be that: the arc-shaped groove plate may be provided with an upwardly opened arc-shaped slot, and the arc-shaped slot is provided with a protrusion far away from one side of the central block, for limiting and fixing each of the arc-shaped connecting plates from its outside, and the arc-shaped connecting plate is provided with a curved surface at its lower end for sliding on the arc-shaped slot.

A further preferred technical solution may be that: the jacking block may include a vertical plane on a side close to the central block, and an arc top surface at an upper end; a lower end of the support block is provided with a lower limit surface configured to limit and fix the downward tilt detachable foot in a manner of abutting on the vertical plane when the detachable foot is inserted; a middle support surface configured to abut on the vertical plane after the detachable foot rotates upwards and unfolds; and an upper arc-shaped surface configured to allow the arc-shaped top surface to enter when the detachable foot rotates and unfolds.

A further preferred technical solution may be that: the upper surface of the protrusion may be a limit plane configured to support an outer plane of the arc-shaped connecting plate when the detachable foot is inserted obliquely to be rotated and expanded, an inner side surface is an installation fixing plane configured to limit and fix the outer plane after the detachable foot is rotated and expanded.

A further preferred technical solution may be that a limit groove may be formed between the outer side surface of the protrusion and the arc-shaped slot, and the arc-shaped connecting plate may be provided with an end corner plate for limiting and fixing the inserted detachable foot by inserting with the limit groove.

A further preferred technical solution may be that: the upper surface of the support block may be provided with an inserting column, and an inner top surface of the connecting groove may be provided with an insertion slot for connecting and fixing the detachable foot on the central body in a rotating and snap-fitting manner through the inserting column.

A further preferred technical solution may be that: the vertical section of the inserting column may be triangular, an upper end is a circular arc end; the support block may be provided with a structural strengthening block that simultaneously connects to the inserting column and the center block.

A further preferred technical solution may be that: the detachable foot may be provided with two main plates for connecting the arc-shaped connecting plate and the jacking block.

A further preferred technical solution may be that: the arc-shaped connecting plate may be provided with structural openings.

A further preferred technical solution may be that: the fixed foot and the center block may be integrally formed.

In the present disclosure, the clamping plate, the arc-shaped groove plate and the support block are arranged on the center block, and the connecting groove, the arc-shaped connecting plate and the jacking block are arranged on the detachable foot to achieve the effective disassembly and assembly of the five-star foot. The present disclosure has a reasonable and effective detachable structure of the five-star foot, the detachable feet may be easy to be engaged and positioned before disassembly and assembly, the resistance during disassembly and assembly may be moderate, the operation may be convenient, the support strength after installation is large. The friction and fixing effect between the detachable feet and the center block is good, the detachable feet are not easy to rotate and fall apart, and the number of detachable feet can be adjustable. The overall disassembly and assembly workload is not much, but the advantages of flexible and efficient disassembly and assembly time can meet different usage requirements.

DETAILED DESCRIPTION OF THE EMBODIMENTS

The following descriptions are only preferred embodiments of the present disclosure, and do not limit the scope of the present disclosure.

Figure 1:
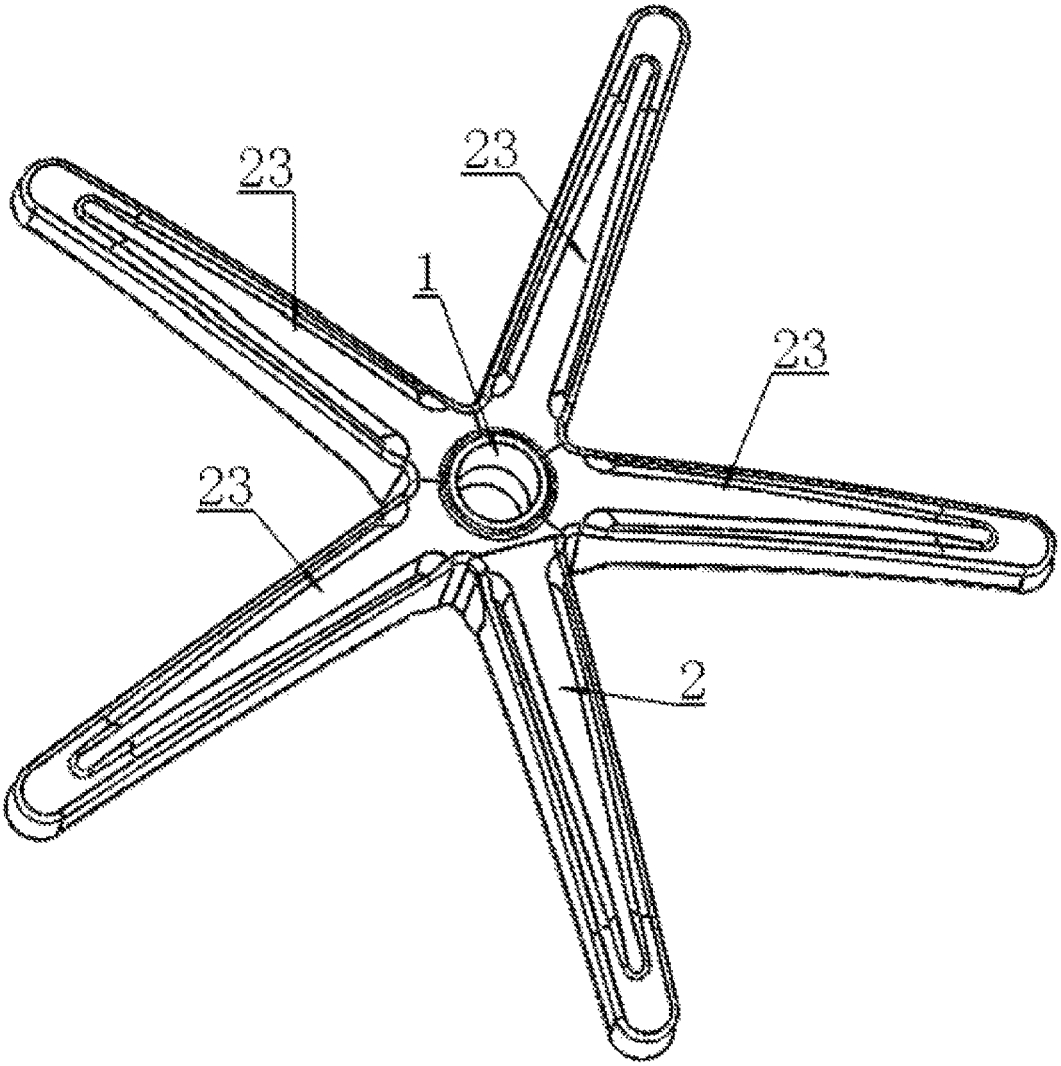
FIG. 1 is a schematic diagram showing a structure of a detachable five-star base according to one embodiment of the present disclosure.
Figure 2:
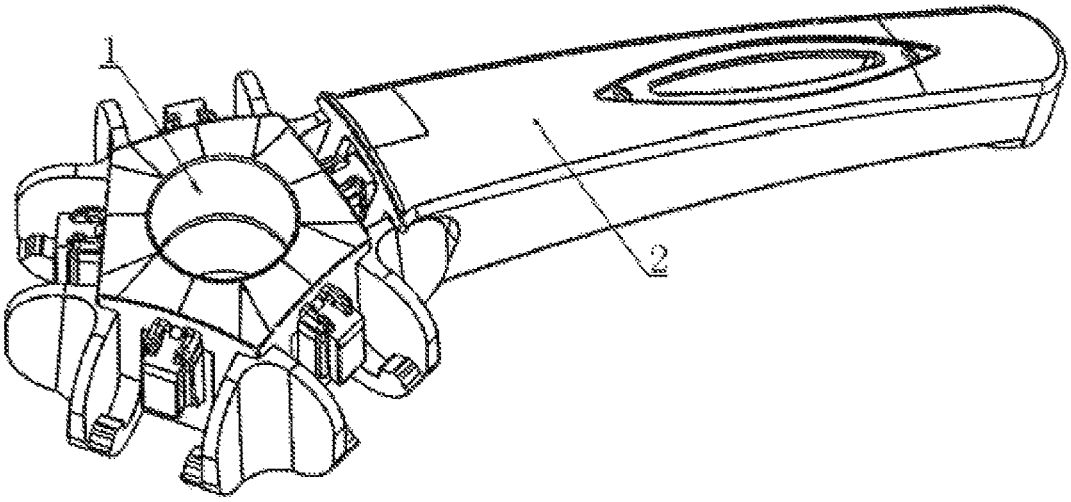
FIG. 2 is a schematic diagram showing the detachable structure of five detachable feet according to one embodiment of the present disclosure.
Figure 3:
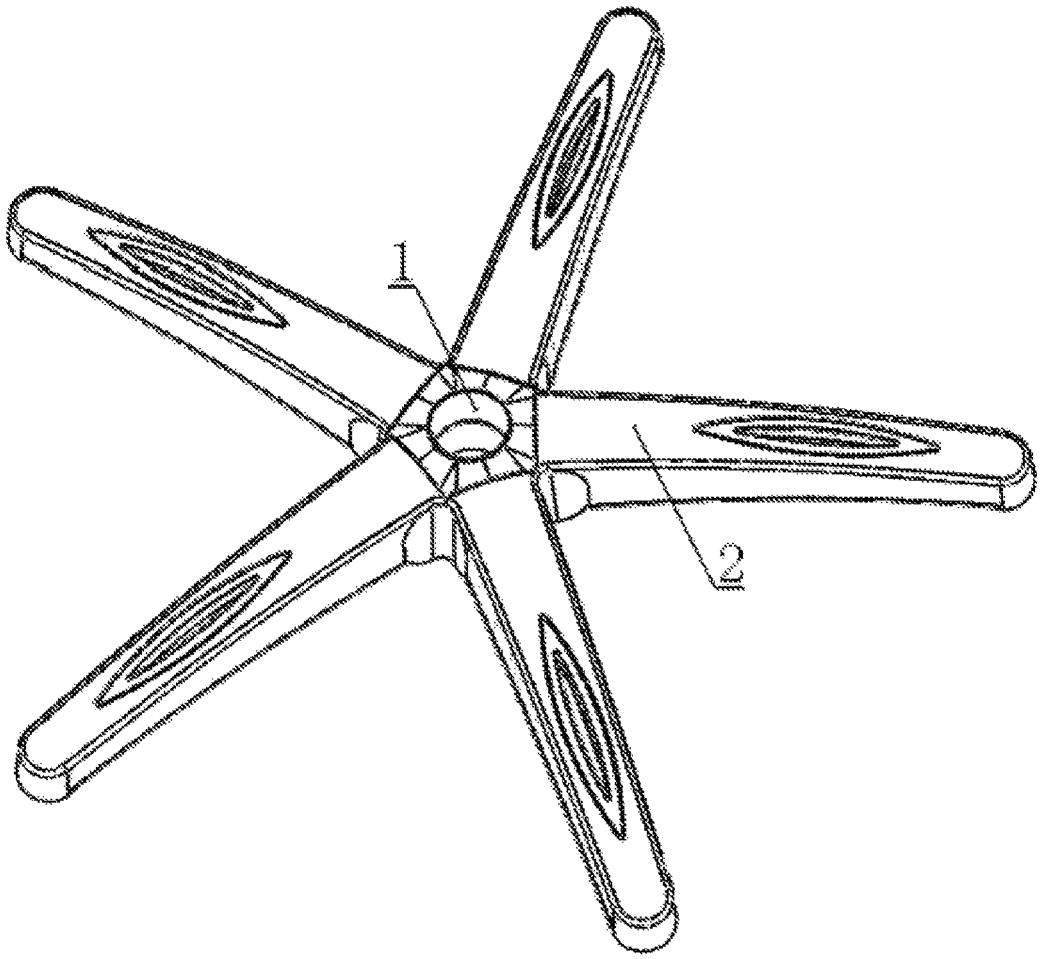
FIG. 3 is an overall schematic view of the five detachable feet according to one embodiment of the present disclosure.
Figure 4:
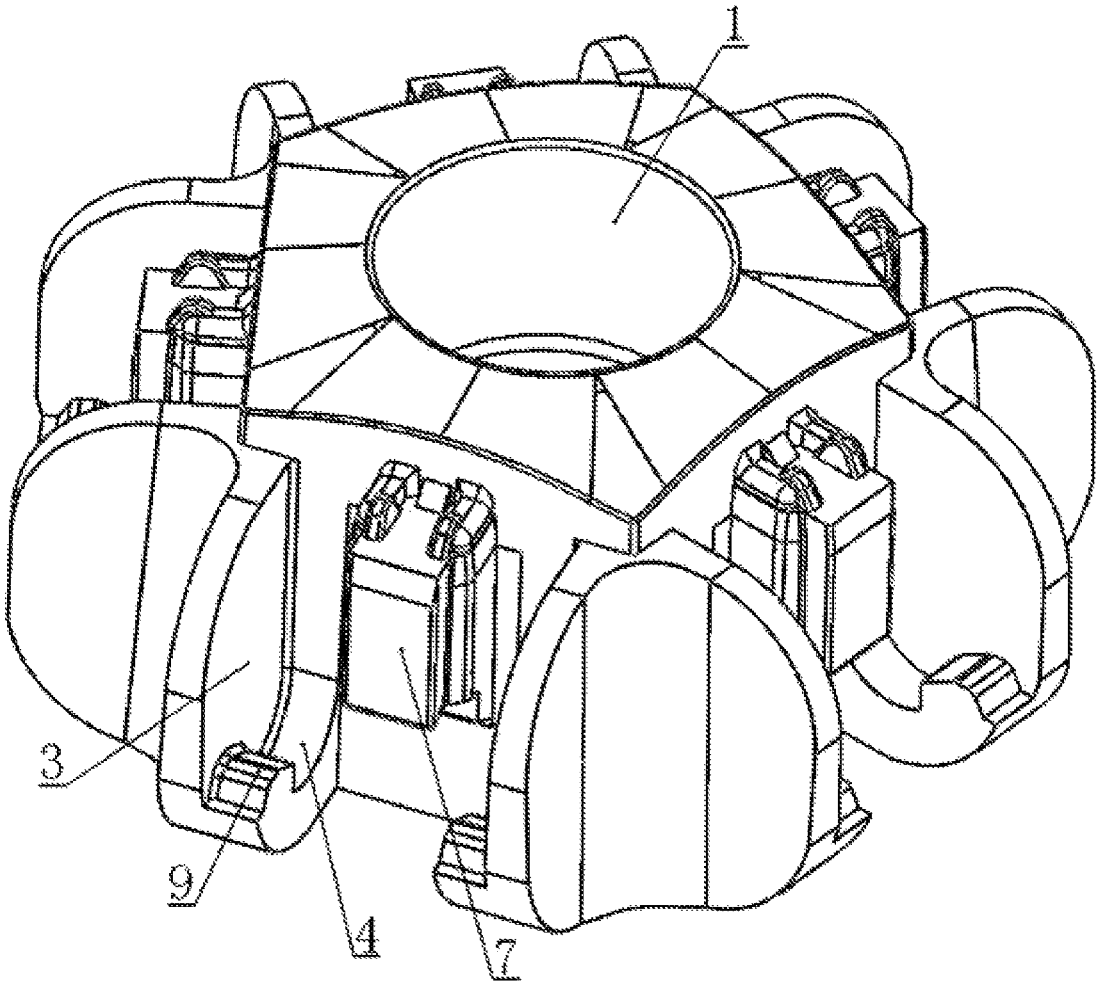
FIG. 4 is a schematic diagram showing the position structure of the arc-shaped groove plate and the support block according to one embodiment of the present disclosure.
Figure 5:
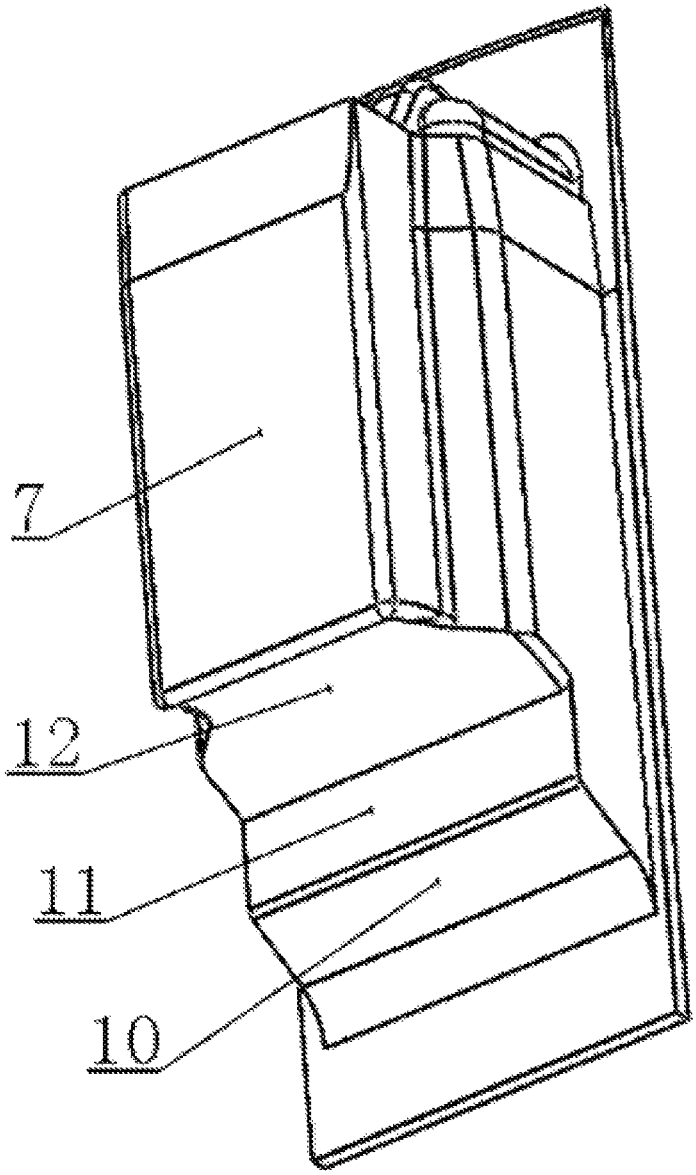
FIG. 5 is a bottom view showing the three positions of the lower limit surface, the middle support surface and the upper arc-shaped surface according to one embodiment of the present disclosure.
Figure 6:
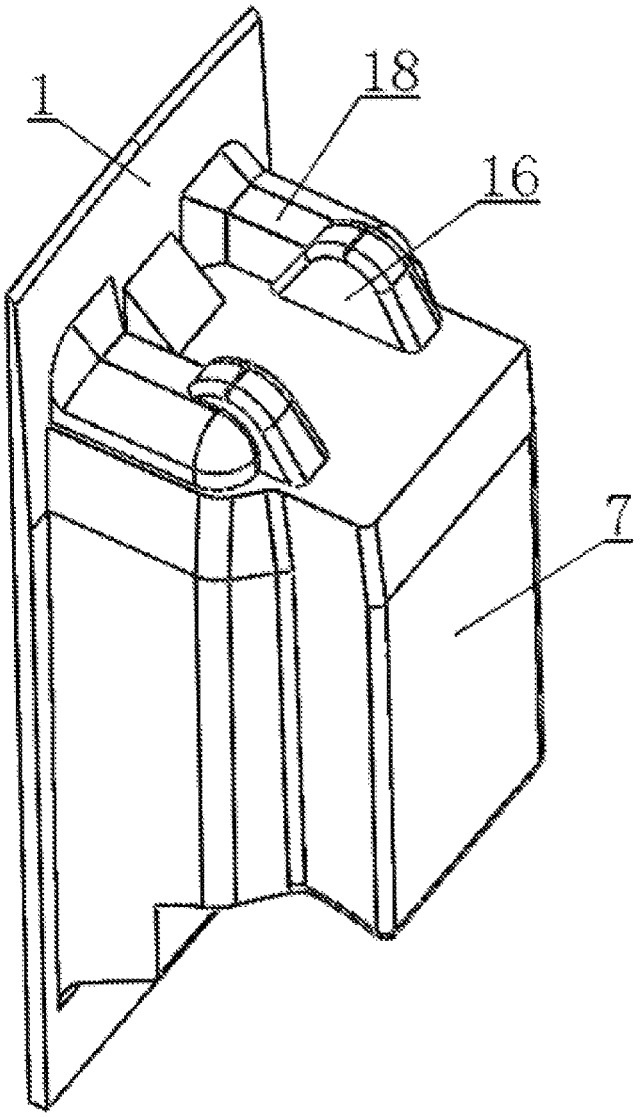
FIG. 6 is a schematic diagram showing the position structure of the inserting column according to one embodiment of the present disclosure.
Figure 7:
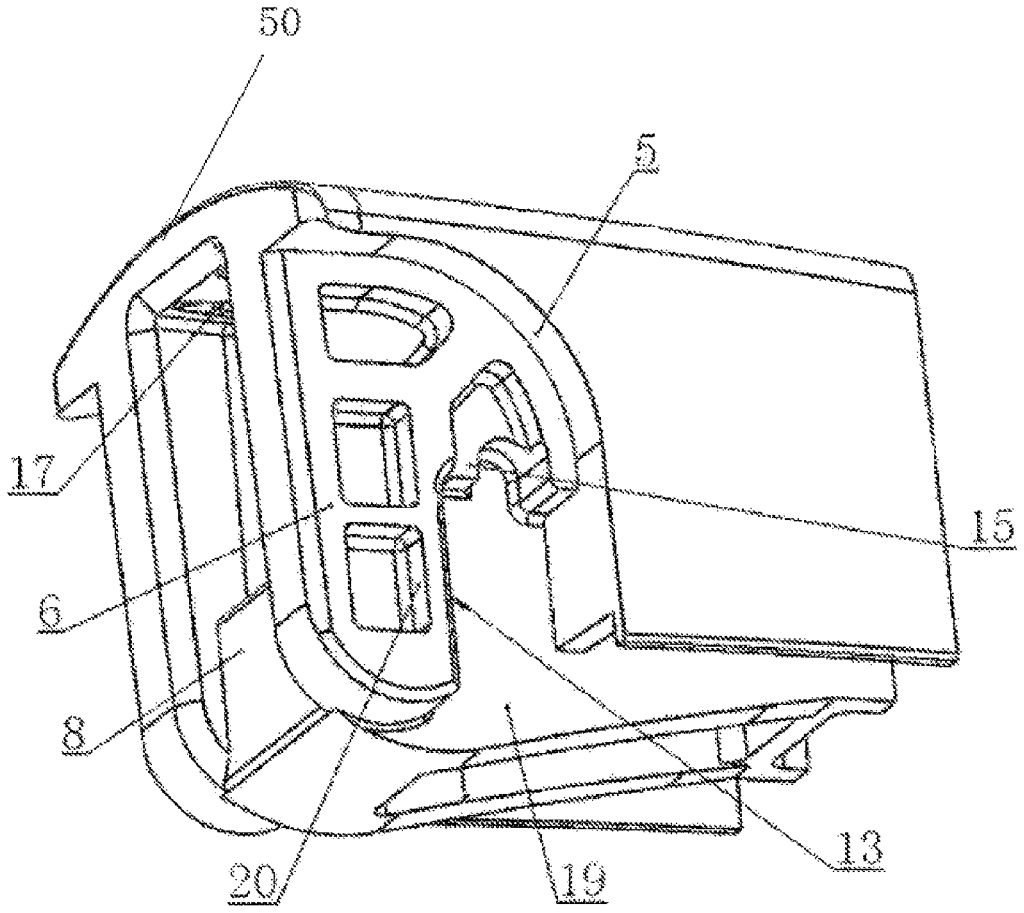
FIG. 7 is a schematic diagram showing the structure of the connecting end of the detachable foot according to one embodiment of the present disclosure.
Figure 8:
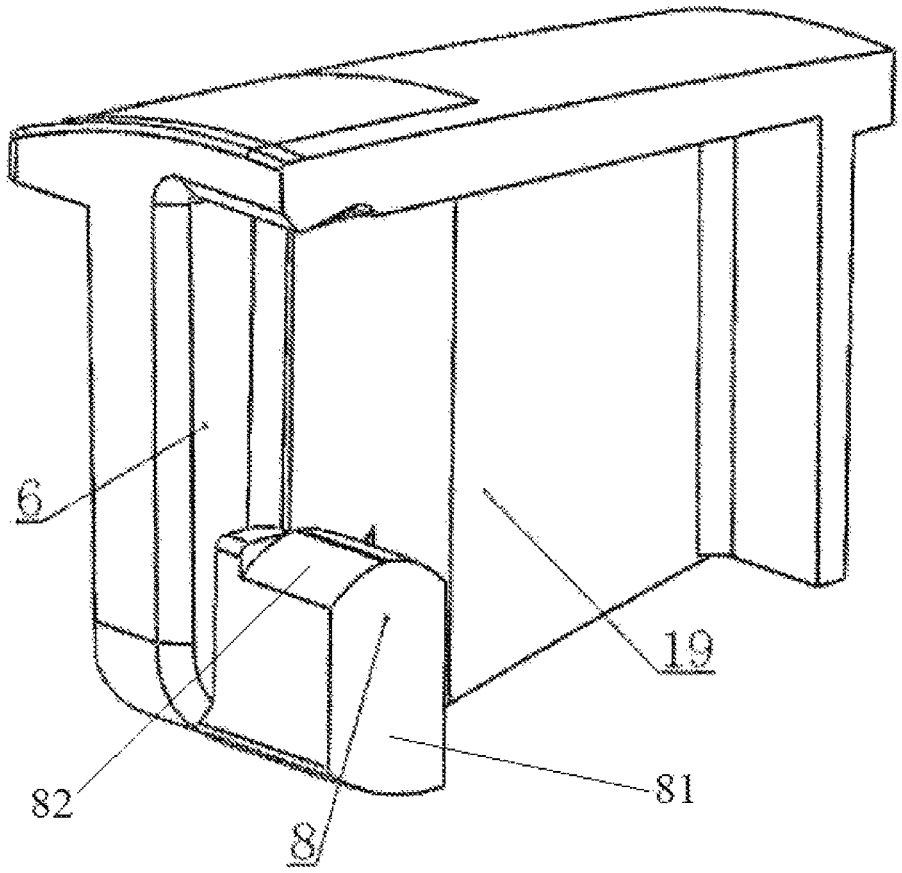
FIG. 8 is a schematic diagram showing the position structures of the jacking block and the main plate according to one embodiment of the present disclosure.
Figure 9:
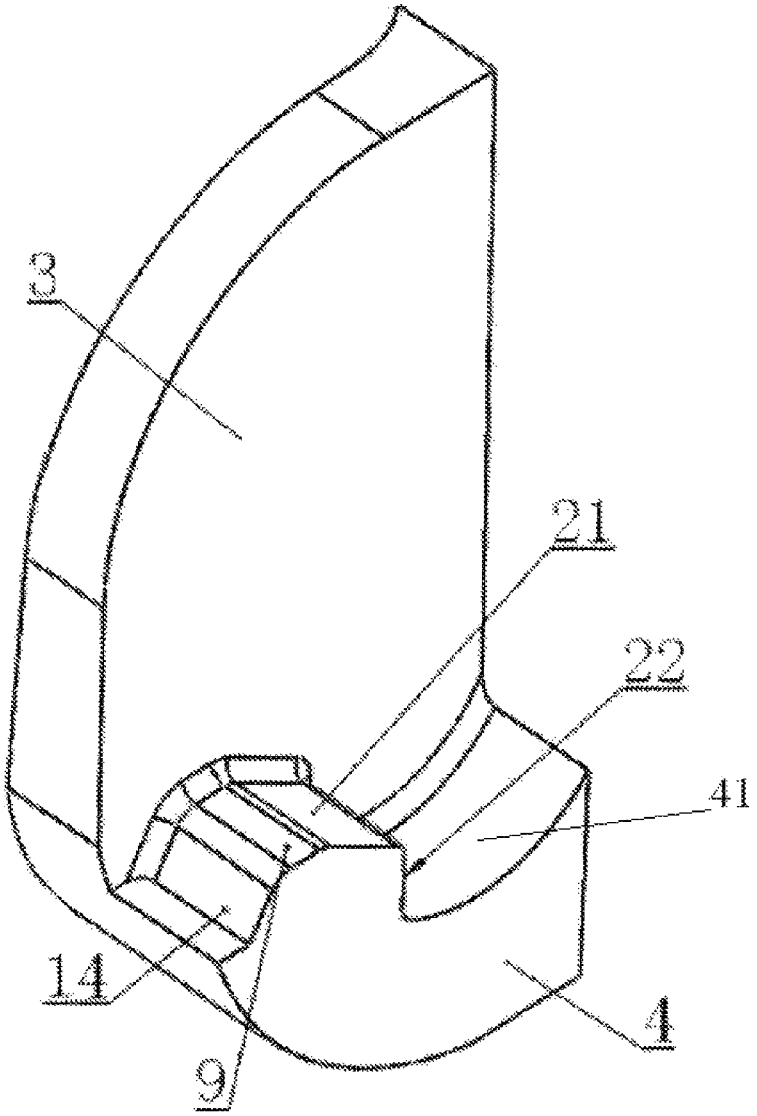
FIG. 9 is a schematic diagram showing the position of the limit plane and the installation fixing plane according to one embodiment of the present disclosure.

Embodiment: As shown in FIGS. 1, 2, 3, 4, 5, 6, 7, 8 and FIG. 9, a detachable five-star base may include an outer pentagonal central block 1 and five feet respectively arranged on the side of the center block 1. The feet may include 1 to 4 detachable feet 2 and the remaining fixed support feet 23, or they may include all 5 detachable feet 2. The detachable five-star base may also include: clamping plates 3 arranged on both sides of the five sides of the center block 1; arc-shaped groove plates 4 arranged at the upper and lower ends of the inner sides of the clamping plates 3; connecting grooves 5 arranged on the connecting ends of the detachable feet 2; arc-shaped connecting plates 6 provided on the connecting grooves 5 and configured for hooking and fixing with the arc-shaped groove plates 5; support blocks 7 provided on the sides of the center block 1 and located between two clamping plates 3, and configured to support upper tank plates 50 of the connecting groove 5; and jacking blocks (8), each of which is arranged between two of the arc-shaped connecting plates 6 and configured to block and limit a lower portion of each of the support blocks 7 before inserting, and to support upwardly after inserting.

In this embodiment, the number of the detachable feet 2 can be 1, 2, 3, 4, and 5, so the number of the corresponding fixed feet 23 may be 4, 3, 2, 1, and 0. The connecting structures between each of the plurality of the detachable feet 2 and the center block 1 may be the same, and different numbers of the detachable feet 2 can make the detachable five-star base have different disassembly and assembly workloads, as well as different disassembly and assembly requirements. That is, the increase in the number of detachable feet 2 may increase the probability of problems with the connecting structure, but the increase in the number of detachable feet can increase the overall service life of the detachable five-star base, otherwise, it is closer to the use effect of the fixed five-star foot.

On the other hand, the connecting structure between the center block 1 and the detachable foot 2 may be five layers in total. From the outside to the inside in sequence, the two clamping plates 3 may be pressed against the inner top surface of the connecting groove 5, the two connecting grooves 5 may be hooked to the arc-shaped connecting plate 6, and the support block 7 in the middle upwardly receives the movement tendency of downward pressing of the connecting groove 5, and downwardly receives the movement tendency of upward pushing of the jacking block 8. Finally, the center block 1 and the detachable foot 2 have the advantages of moderate difficulty in disassembly and assembly, and high support strength after installation.

The arc-shaped groove plate 4 may be provided with an upwardly opened arc-shaped slot 41 is provided with a protrusion 9 far away from one side of each of the central blocks 1, for limiting and fixing each of the arc-shaped connecting plates 6 from an outside of the central blocks 1. The lower end of the arc-shaped connecting plate 6 may be provided with an arc-shaped surface for sliding on the arc-shaped slot 41. The jacking block 8 may include a vertical plane 81 on the side close to the center block 1 and an arc-shaped top surface 82 at the upper end. The lower end of the support block 7 may be provided with a lower limit surface 10 configured to limit and fix the downward tilt detachable foot 2 in a manner of abutting on the vertical plane 81 when the detachable foot 2 is inserted; a middle support surface 11 configured to abut on the vertical plane 81 after the detachable foot 2 rotates upwards and unfolds; and an upper arc-shaped surface 12 configured to allow the arc-shaped top surface 82 to enter when the detachable foot 2 rotates and unfolds.

In this embodiment, the sequence of failures of the three acting surfaces at the lower end of the support block 7 may be as follows:

First, the connecting end of the detachable foot 2 faces upwards, and the outer roller mounting end faces downwards, the arc-shaped connecting plate 6 may be inserted into the arc-shaped groove plate 4 at an angle of about 15° in the vertical angle. At this time, the outer plane of the jacking block 8 may be in contact with the lower limit surface 10, and the detachable foot 2 will not fall when suspended;

Secondly, the outer roller mounting end at the detachable foot 2 may be lifted up, and the arc-shaped top surface of the jacking block 8 starts to contact and fit with the upper arc-shaped surface 12;

Finally, when the roller mounting end rotates until the end surface of the connecting groove 5 abuts on the side surface of the center block 1, the arc-shaped top surface of the jacking block 8 rotates in the upper arc-shaped surface 12 completely, the outer plane of the jacking block 8 abuts on the middle support surface 11. So far, the support block 7 may be pressed on the jacking block 8 to block the upward tendency of the jacking block 8. As a supplement to the supporting force between the side surface of the connecting groove 5 and the side surface of the central block 1, It supports the sinking tendency of the central block 1 after the detachable five-star base is under pressure.

The upper surface of the protrusion 9 may be a limit plane 21 used to support the outer plane 13 of the arc-shaped connecting plate 6 when the detachable foot 2 is inserted obliquely to be rotated and expanded. The inner side surface may be an installation fixing plane 22 configured to limit and fix the outer plane 13 after the detachable foot 2 is rotated and expanded. A limit groove 14 may be formed between the outer surface of the protrusion 9 and the arc-shaped slot. The arc-shaped connecting plate 6 may be provided with an end corner plate 15 for limiting and fixing the inserted detachable foot 2 by inserting with the limit groove 14.

In this embodiment, when the detachable foot 2 is kept inserted at the above 15° angle to be rotated and expanded, the outer plane of the jacking block 8 and the lower limit surface 10 may abut together, which may be the first limit position. The outer plane 13 of the arc-shaped connecting plate 6 may be pressed on the limit plane 21, which is the second limit position. At last, the end corner plate 15 may be inserted into the limit groove 14, which is the third limit position after the detachable foot 2 is inserted, and finally the detachable foot 2 may be inserted into the inner side of the protrusion 9 of the arc-shaped groove plate 4 through the arc-shaped connecting plate 6, it can remain stable and avoid falling out.

Wherein, when the detachable foot 2 is fully rotated and expanded, the outer plane 13 may abut on the installation fixing plane 22. At this time, the arc-shaped connecting plate 6 has a tendency of outward pushing protrusion 9, the protrusion 9 blocks the limit by its structural rigidity to ensure that the arc-shaped connecting plate 6 will not rotate and slide out when the detachable five-star base is under pressure. That is, one of the ways that the connecting structure of the detachable foot 2 gets broken may be that the protrusion 9 falls off the arc-shaped groove plate 4.

The upper surface of the support block 7 may be provided with an inserting column 16, and the inner top surface of the connecting groove 5 may be provided with an insertion slot 17 for connecting and fixing the detachable foot 2 on the central body 1 in a rotating and snap-fitting manner through the inserting column 16. A vertical section of the inserting column 16 may be triangular, an upper end may be a circular arc end. The support block 7 may be provided with a structural strengthening block 18 that simultaneously connects to the inserting column 16 and the center block 1. The detachable foot 2 may be provided with two main plates 19 for connecting the arc-shaped connecting plate 6 and the jacking block 8. The arc-shaped connecting plate 6 may be provided with structural openings 20.

In this embodiment, the arc-shaped connecting plate 6 may be hooked with the arc-shaped groove plate 4 and the protrusion 9. The jacking block 8 may be pushed upward on the support block 7. When the detachable foot 2 is in use, it can already guarantee a certain supporting effect, but the strength may be far from enough. Therefore, the upper groove body plate of the connecting groove 5 may be pressed against the side of the center block 1 and pressed against the support block 7 on the upper surface, so that sufficient support strength can be ensured. If the upper groove plate of the connecting groove 5 does not break, the upper support structure will continue to be effective. Similarly, the arc-shaped connecting plate 6 and the protrusion 9 do not break, the lower end hook structure may be also continuously effective.

Wherein, the main plate 19 axially penetrates the entire detachable foot 2, the main body of the detachable foot 2 may be an inverted U shape. The main plate 19 can ensure the installation strength of the arc-shaped connecting plate 6 and the jacking block 8. When the main plate 19 is absent, the arc-shaped connecting plate 6 can also be connected to the connecting groove 5 to ensure the above-mentioned hooking effect, but the strength may be obviously insufficient, so the main plate 19 is used to strengthen the connection and ensure the installation stability of the arc-shaped connecting plate 6 and the jacking block 8.

The fixed feet 23 and the center block 1 may be integrally formed.

In this embodiment, the central block 1 has a structure with an outer pentagonal shape and inner circular shape. If there are the fixed feet 23, then they may be integrally formed with the central block 1, and the material can be hard engineering plastics. As the number of the fixed feet 23 gradually increases, the structure and use function of the detachable five-star foot may be closer to the integrated five-star foot.

The embodiment of the present disclosure has been described in detail above with reference to the accompanying drawings, but the present disclosure is not limited to the above-mentioned embodiment. Within the scope of knowledge possessed by those of ordinary skill in the technical field, the various modifications may be made without departing from the purpose of the present disclosure. These are all modifications that are not creative, as long as they are protected by the patent law within the scope of the claims of the present disclosure.

What is claimed is:

1. A detachable five-star base comprising an outer pentagonal central block, and five support feet respectively arranged on five side surfaces of the central block, wherein: in the support feet, one to four detachable feet and remaining fixed foot are provided, or only five detachable feet are provided; the detachable five-star base further comprises:

clamping plates provided on both sides of each side surface of the central block;

arc-shaped groove plates arranged at upper and lower ends of inner sides of the clamping plate;

connecting grooves arranged on the detachable feet on connecting ends;

arc-shaped connecting plates provided on the connecting grooves and configured for hooking and fixing with the arc-shaped groove plates;

support blocks provided on side surfaces of the center block and located between two clamping plates, and configured to support upper tank plates of the connecting grooves; and jacking blocks, each of which is arranged between two of the arc-shaped connecting plates and configured to block and limit a lower portion of each of the support blocks before inserting, and to support the lower portion of each of the support blocks after inserting;

each jacking block comprises a vertical plane on a side close to the central block, and an arc top surface at an upper end; a lower end of the support block is provided with a lower limit surface configured to limit and fix a downward tilt detachable foot in a manner of abutting on the vertical plane when each detachable foot is inserted; a middle support surface configured to abut on the vertical plane after each detachable foot rotates upwards and unfolds; and an upper arc-shaped surface configured to allow the arc top surface to enter when each detachable foot rotates and unfolds;

an upper surface of the support block is provided with an inserting column, and an inner top surface of the connecting groove is provided with an insertion slot for connecting and fixing each detachable foot on the central block in a rotating and snap-fitting manner through the inserting column.

2. The detachable five-star base according to claim 1, wherein: each of the arc-shaped groove plates is provided with an upwardly opened arc-shaped slot, and the arc-shaped slot is provided with a protrusion far away from one side of each of the central blocks, for limiting and fixing each of the arc-shaped connecting plates from an outside of the central blocks, and a lower end of each of the arc-shaped connecting plates is provided with an arc-shaped surface for sliding on the arc-shaped slot.

3. The detachable five-star base according to claim 2, wherein: an upper surface of the protrusion is a limit plane configured to support an outer plane of the arc-shaped connecting plate when each detachable foot is inserted obliquely to be rotated and expanded, an inner side surface is an installation fixing plane configured to limit and fix the outer plane after each detachable foot is rotated and expanded.

4. The detachable five-star base according to claim 2, wherein: a limit groove is formed between an outer surface of the protrusion and the arc-shaped slot; the arc-shaped connecting plate is provided with an end corner plate for limiting and fixing the inserted detachable foot by inserting with the limit groove.

5. The detachable five-star base according to claim 4, wherein: a vertical section of the inserting column is triangular, an upper end is a circular arc end; the support block is provided with a structural strengthening block that simultaneously connects to the inserting column and the center block.

6. The detachable five-star base according to claim 1, wherein: each detachable foot is provided with two main plates for connecting the arc-shaped connecting plate and each jacking block.

7. The detachable five-star base according to claim 1, wherein: the arc-shaped connecting plate is provided with structural openings.

8. The detachable five-star base according to claim 1, wherein each fixed foot and the central block are integrally formed.

* * * * *